US008087261B2

(12) United States Patent
Lee et al.

(10) Patent No.: US 8,087,261 B2
(45) Date of Patent: Jan. 3, 2012

(54) DEFROSTER FOR EVAPORATOR IN REFRIGERATOR

(75) Inventors: Sang Ik Lee, Cheongju-si (KR); Bong Jun Choi, Changwon-si (KR); Jong Min Sin, Pusan (KR); Youngsan Jeon, Yongin-si (KR); Jae Seong Sim, Masan-si (KR); Young Jeong, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 493 days.

(21) Appl. No.: 10/574,656

(22) PCT Filed: Oct. 11, 2004

(86) PCT No.: PCT/KR2004/002589

§ 371 (c)(1),
(2), (4) Date: Apr. 4, 2006

(87) PCT Pub. No.: WO2005/052474

PCT Pub. Date: Jun. 9, 2005

(65) Prior Publication Data

US 2007/0000271 A1 Jan. 4, 2007

(30) Foreign Application Priority Data

Nov. 28, 2003 (KR) ..... 10-2003-0085613
Aug. 11, 2004 (KR) ..... 10-2004-0063034

(51) Int. Cl.
*F25D 17/04* (2006.01)

(52) U.S. Cl. ..... 62/407; 62/151; 62/152; 62/154; 62/186; 62/187; 62/404; 62/408; 62/440; 62/441; 62/276; 454/259; 454/353; 454/359

(58) Field of Classification Search ..... 62/276, 62/151, 407, 152, 154, 186, 187, 404, 408, 62/440, 441; 454/259, 353, 359
See application file for complete search history.

(56) References Cited

U.S. PATENT DOCUMENTS 2,000,467 A * 5/1935 Lindseth ..... 165/259
2,191,774 A * 2/1940 Reed ..... 454/349
3,786,227 A * 1/1974 Seipp et al. ..... 219/201
4,369,350 A * 1/1983 Kobayashi et al. ..... 219/201

(Continued)

FOREIGN PATENT DOCUMENTS

DE 198 10 232 1/1999

(Continued)

OTHER PUBLICATIONS

German Office Action dated Jun. 17, 2009.

*Primary Examiner* — Frantz Jules
*Assistant Examiner* — Azim Rahim
(74) *Attorney, Agent, or Firm* — KED & Associates LLP

(57) ABSTRACT

A refrigerator is provided that includes a cold air duct that receives cold air circulating inside of a refrigerating chamber and a freezing chamber, an evaporator in the cold air duct, at least one defrosting heater in the cold air duct that selectively emits heat, a fan in the cold air duct, that selectively directs the cold air in an upward or downward direction, a motor that drives the fan, and an open/close device that closes a space having the evaporator, the defrosting heater, and the fan positioned therein selectively, thereby providing an improved defroster for an evaporator.

20 Claims, 16 Drawing Sheets

U.S. PATENT DOCUMENTS

| | | | | |
|---|---|---|---|---|
| 4,614,092 | A * | 9/1986 | Kim et al. | 62/408 |
| 5,156,015 | A * | 10/1992 | Chung | 62/187 |
| 5,594,585 | A * | 1/1997 | Komatsu | 359/512 |
| 5,765,384 | A * | 6/1998 | Carlstedt et al. | 62/276 |
| 5,941,085 | A * | 8/1999 | Jeon | 62/151 |
| 5,987,904 | A * | 11/1999 | Kim et al. | 62/131 |
| 6,286,326 | B1 * | 9/2001 | Kopko | 62/179 |
| 6,293,122 | B1 | 9/2001 | Chang | |
| 6,694,754 | B1 * | 2/2004 | Schenk et al. | 62/156 |
| 2002/0192075 | A1 * | 12/2002 | Block | 415/176 |

FOREIGN PATENT DOCUMENTS

| | | |
|---|---|---|
| DE | 198 44 854 | 4/2000 |
| DE | 102 58 455 | 7/2003 |
| DE | 69820100 T | 8/2004 |
| EP | 0 872 697 | 10/1998 |
| EP | 0 878 675 | 11/1998 |
| JP | 10232079 | 9/1998 |
| KR | 1995-0003602 | 2/1994 |
| KR | 1998-0010548 | 6/1998 |
| KR | 1999-0036171 | 9/1999 |

* cited by examiner

DEFROSTER FOR EVAPORATOR IN REFRIGERATOR

TECHNICAL FIELD

The present invention relates to refrigerator, and more particularly, to a defroster for an evaporator in a refrigerator for removing frost from a surface of the evaporator.

BACKGROUND ART

In general, the refrigerator repeats a refrigerating cycle in which refrigerant is compressed-condensed-expanded-evaporated, for cooling down an inside thereof for fresh storage of food, and the like.

For forming the refrigerating cycle of the refrigerant, the refrigerator is provided with a compressor, a condenser, an expansion valve, and an evaporator. The compressor boosts gaseous refrigerant from low temperature/pressure to high temperature/pressure, and the condenser receives the refrigerant from the compressor, and makes the refrigerant to heat exchange with external air, to condense the refrigerant. The expansion valve has a diameter smaller than other portion, for dropping a pressure of the refrigerant from the condenser. The evaporator absorbs heat from the refrigerator as the refrigerant passed through the expansion valve is evaporated at a low pressure.

The structure, and operation of a related art refrigerator will be described with reference to the attached drawings. FIG. 1 illustrates a longitudinal section of a related art refrigerator schematically, and FIG. 2 illustrates a longitudinal section of a defrosting process of an evaporator in a related art refrigerator.

Referring to FIG. 1, an inside of a refrigerant case 100 is partitioned into a freezing chamber 110 and a refrigerating chamber 111 with a barrier 101. Though the freezing chamber and the refrigerating chamber can be partitioned in up/down direction as shown, the freezing chamber and the refrigerating chamber can be partitioned in left/right direction. In the meantime, the barrier 101 has at least one communication hole 101*a* for free flow of cold air between the freezing chamber and the refrigerating chamber.

In general, the freezing chamber 110 has cold air heat exchanged at the evaporator 200, and introduced thereto, to maintain a temperature thereof at about −18° C., and the refrigerating chamber 111 has the cold air passed through the freezing chamber 110, to maintain a temperature thereof at about 0-7° C.

Behind the freezing chamber 110, there is a cold air duct 500 for receiving the air passed through the freezing chamber and refrigerating chamber for heat exchange. For this, the cold air duct 500 has a cold air outlet 510 and a cold air inlet 520 in an upper portion and a lower portion, respectively.

Inside of the cold air duct 500, there are an evaporator 200, a fan 400, and a motor 410. The motor 410 drives the fan, and the fan 400 forcibly circulates the cold air cooled down as the air passes through the evaporator 200 through the freezing chamber 110. Under the duct 500, there is a machine room 120, provided with the compressor and the condenser of the refrigerating cycle, and a heat dissipation fan for forcibly blowing air to cool down heat generated at the condenser.

In the meantime, the operation of the refrigerator will be described.

Upon tuning on power in a state the freezing chamber 110, and the refrigerating chamber 111 is filled with food, the compressor in the machinery room is operated in response to a control signal from a controller (not shown), and the evaporator 200 makes heat exchange with air inside of the refrigerator according to the refrigerating cycle. According to this, the air is discharged to the freezing chamber 110 by the fan 400 after the air is cooled down as the air heat exchanges with the refrigerant passing through the evaporator 200, and a portion of the cooled air is introduced into the refrigerating chamber 111 through the communication hole 101*a* Thereafter, the cold air heated as the air circulates through the freezing chamber 110 and the refrigerating chamber 111 is introduced into the duct 500 through the cold air inlet 520.

In the meantime, moisture in the cold air forms frost on the evaporator 200 during operation. While a surface of the evaporator 200 has a low temperature, an environmental temperature is relatively high, dew is formed on the surface of the evaporator, which is frozen on the surface of the evaporator 200, to form the frost.

Since the frost impedes flow of the cold air, leading cooling efficiency poor, defrosting operation is required for removing the frost in regular time intervals. For this, there are a plurality of defrosting heaters 300 around the evaporator 200.

In the defrosting heater 300, there are contact defrosting heaters (not shown) in contact with the evaporator 200 for transmission of heat to fins on the evaporators 200, and non-contact defrosting heater 300 spaced from a predetermined distance from the evaporator 200 for transmission of heat to the fins on the evaporator by radiation. Depending on refrigerators, either, or both defrosting heaters are applied.

In the defrosting operation, by applying power to the defrosting heater 300 for a predetermined time period to transmit heat to the fins on the evaporator 200, the frost can be melted down, and remove the frost, from the evaporator 200. Water from the frost is drained through a drainpipe to an outside of the refrigerator, or evaporated for itself.

In the meantime, because of temperature rise due to heat from the defrosting heater 300, there is a high cooling load at an initial operation of the next refrigerating cycle, to put a great burden on the evaporator 200, leading a cooling efficiency poor, at the end.

Moreover, since the defrosting heater 300 receives power to generate heat, excessive power is required for elevating a temperature to a required level, that increases power consumption.

DISCLOSURE OF INVENTION

Accordingly, the present invention is directed to a refrigerator that substantially obviates one or more problems due to limitations and disadvantages of the related art.

An object of the present invention is to provide a refrigerator having an improved defroster.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator includes a cold air duct for receiving cold air circulating insides of a refrigerating chamber and a freezing chamber, an evaporator in the cold air duct, at least one defrosting heater in the cold air duct for selective emission of heat, a fan in the cold air duct, for selective direction of the cold air in upward or downward, a motor for driving the fan, and open/close means for closing a space having the evaporator, the defrosting heater, and the fan positioned therein, selectively.

The open/close means includes a first open/close part on an upper side of the space, and a second open/close part on a lower side of the space.

The first and second open/close parts each includes a supporting plate having a plurality of openings, and a plurality of rotating plates each having one side coupled to the supporting plate with a hinge, and the other side rotatable upward by a predetermined angle. The rotating plate is constructed from a thin plate, so that the rotating plate is rotated upward by a predetermined angle to open the opening when the cold air is directed upward by the fan.

The rotating plate has a size enough to cover an upper circumference of the opening for closing the opening when the cold air is directed downward by the fan. The rotating plate is held by a rear end of an adjacent rotating plate and the supporting plate, for preventing the rotating plate from rotating downward.

The fan is positioned over the evaporator. The defrosting heater is positioned between the fan an the evaporator. The defrosting heater is fabricated as one unit with the fan.

The defrosting heater includes a hot wire for functioning as a resistance body connected to a power source for emission of heat, and a film of an electrical insulating material surrounding an outside of the hot wire. The evaporator includes a refrigerant pipe having refrigerant flowing therethrough, and fins on an outside of the refrigerant pipe.

In another aspect of the present invention, a refrigerator includes a cold air duct for receiving cold air circulating insides of a refrigerating chamber and a freezing chamber, an evaporator in the cold air duct, the evaporator having refrigerant pipes having refrigerant flowing therethrough, and fins on outsides of the refrigerant pipes, and at least one defrosting heater in contact with the fins for selective emission of heat.

The defrosting heater includes a hot wire for functioning as a resistance body connected to a power source for emission of heat, and a film of an electrical insulating material surrounding an outside of the hot wire. The hot wire is a carbon hot wire bent closely.

The film is formed of PET material. The defrosting heater is a PTC device. The defrosting heater is attached to at least one surface of the fins. The defrosting heater is attached to one side circumferences of the fins.

The defrosting heater has pass through holes for pass through of the refrigerant pipes. The fins of the evaporator have insertion slots in side surfaces for inserting the defrosting heater.

The refrigerator further includes open/close means provided to an upper portion and a lower portion of the space for selective closure of the space having the evaporator and the defrosting heater positioned therein. The refrigerator further includes a fan in the cold air duct for selective direction of the cold air to upward or downward, and a motor for driving the fan.

The open/close part includes a supporting plate having a plurality of openings, and a plurality of rotating plates each having one side coupled to one side of the supporting plate with a hinge, and the other side rotatable upward by a predetermined angle.

The rotating plate is constructed from a thin plate, so that the rotating plate is rotated upward by a predetermined angle to open the opening when the cold air is directed upward by the fan. The rotating plate has a size enough to cover an upper circumference of the opening for closing the opening when the cold air is directed downward by the fan.

It is to be understood that both the foregoing general description and the following detailed description of the present invention are exemplary and explanatory and are intended to provide further explanation of the invention as claimed.

BRIEF DESCRIPTION OF DRAWINGS

The accompanying drawings, which are included to provide a further understanding of the invention and are incorporated in and constitute a part of this application, illustrate embodiment(s) of the invention and together with the description serve to explain the principle of the invention. In the drawings.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

Refrigerators in accordance with preferred embodiments of the present invention will be described in detail with reference to FIGS. 3~16.

Figure 1:
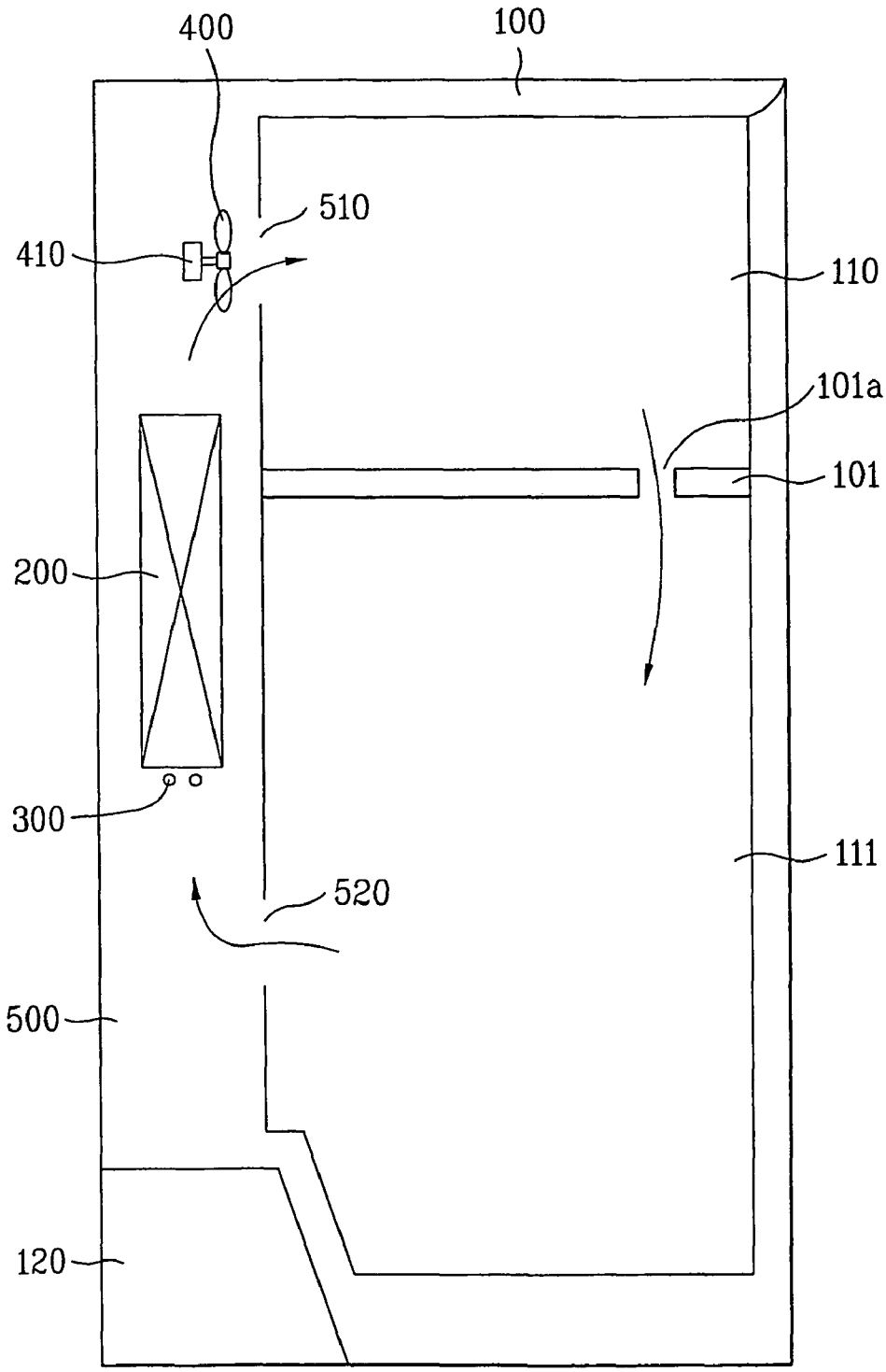
FIG. 1 illustrates a section of a related art refrigerator.
Figure 2:
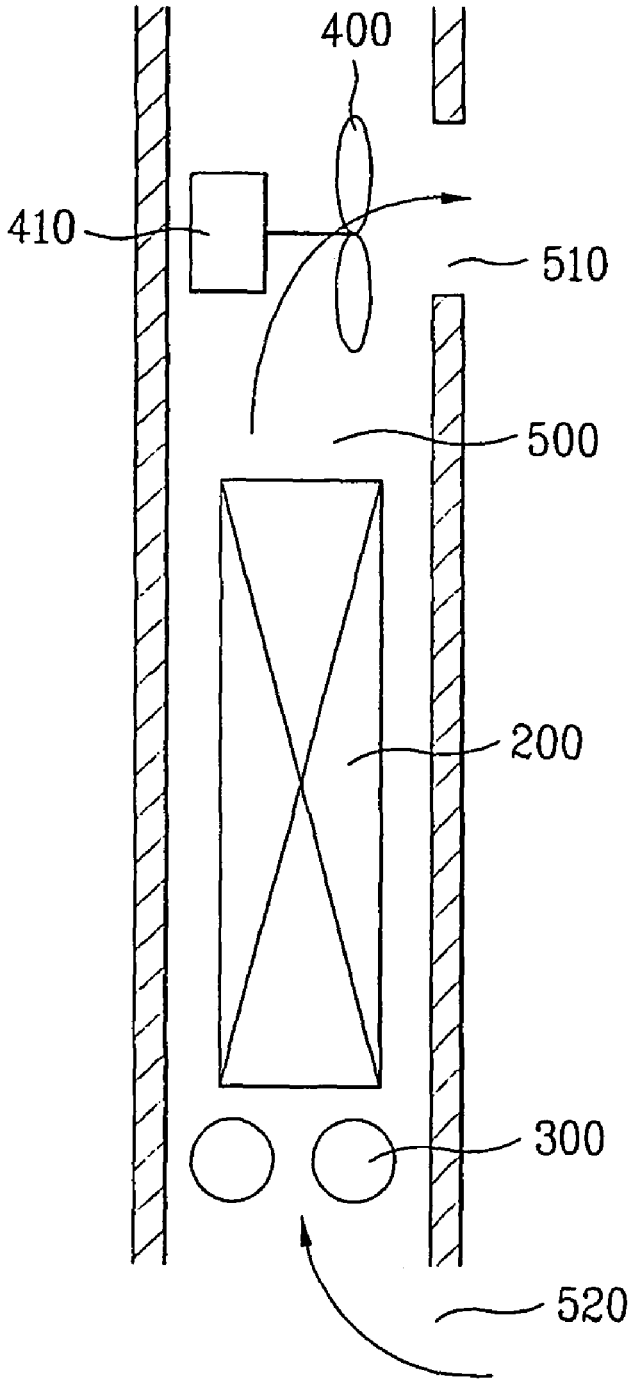
FIG. 2 illustrates a section of a related art defroster for an evaporator.
Figure 3:
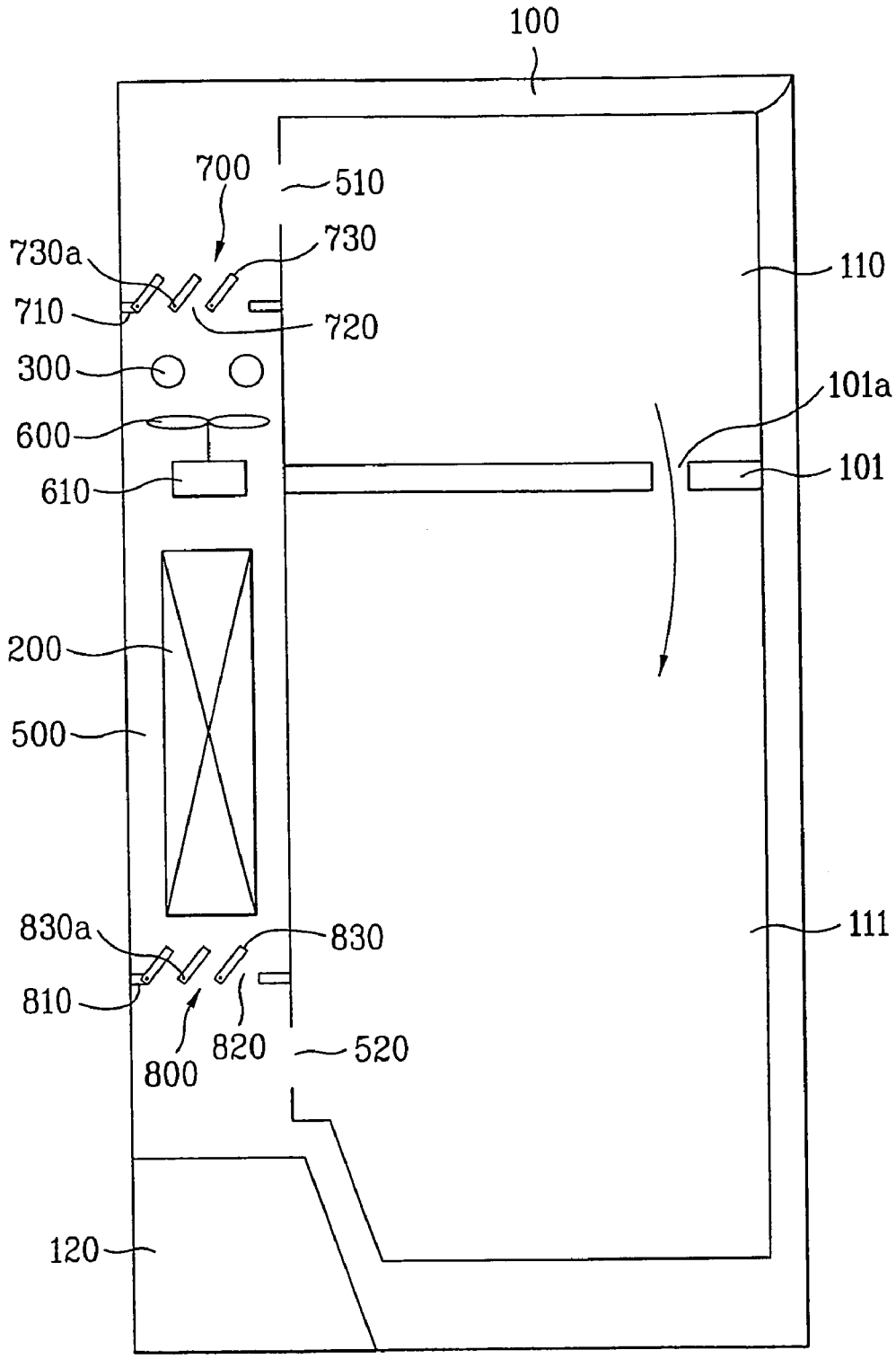
FIG. 3 illustrates a section of refrigerator in accordance with a preferred embodiment of the present invention, schematically.
Figure 4:
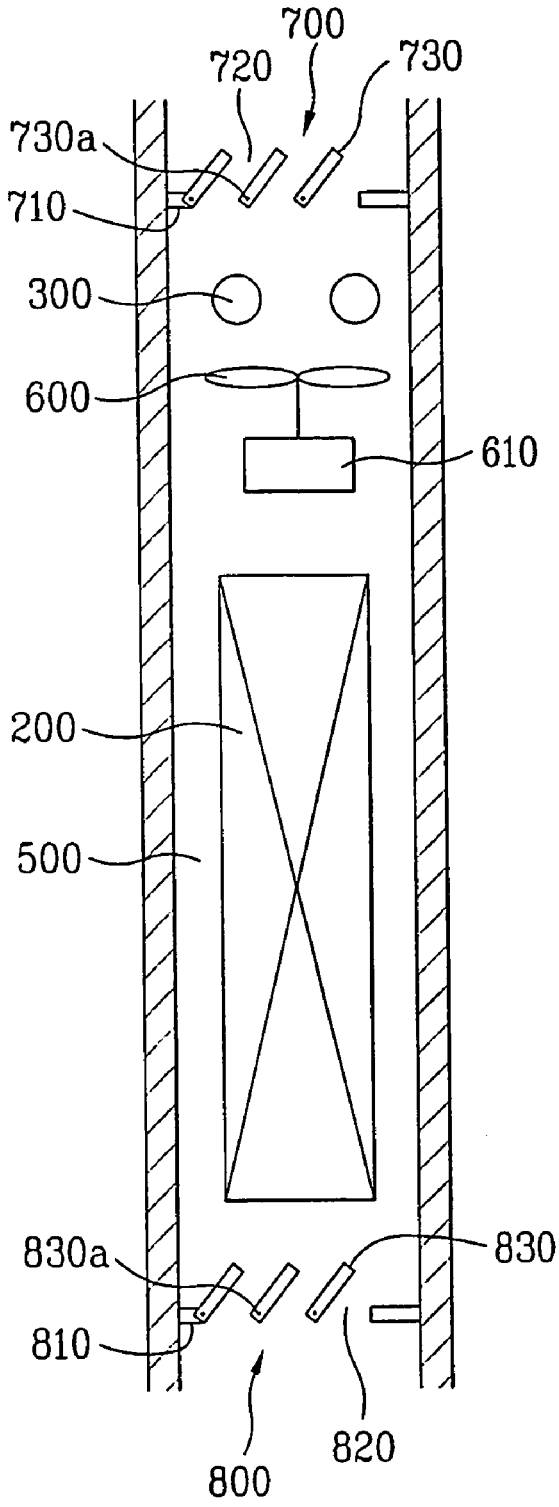
FIGS. 4 to 6 illustrate sections each showing open/close means for a defroster in accordance with a preferred embodiment of the present invention.
Figure 5:
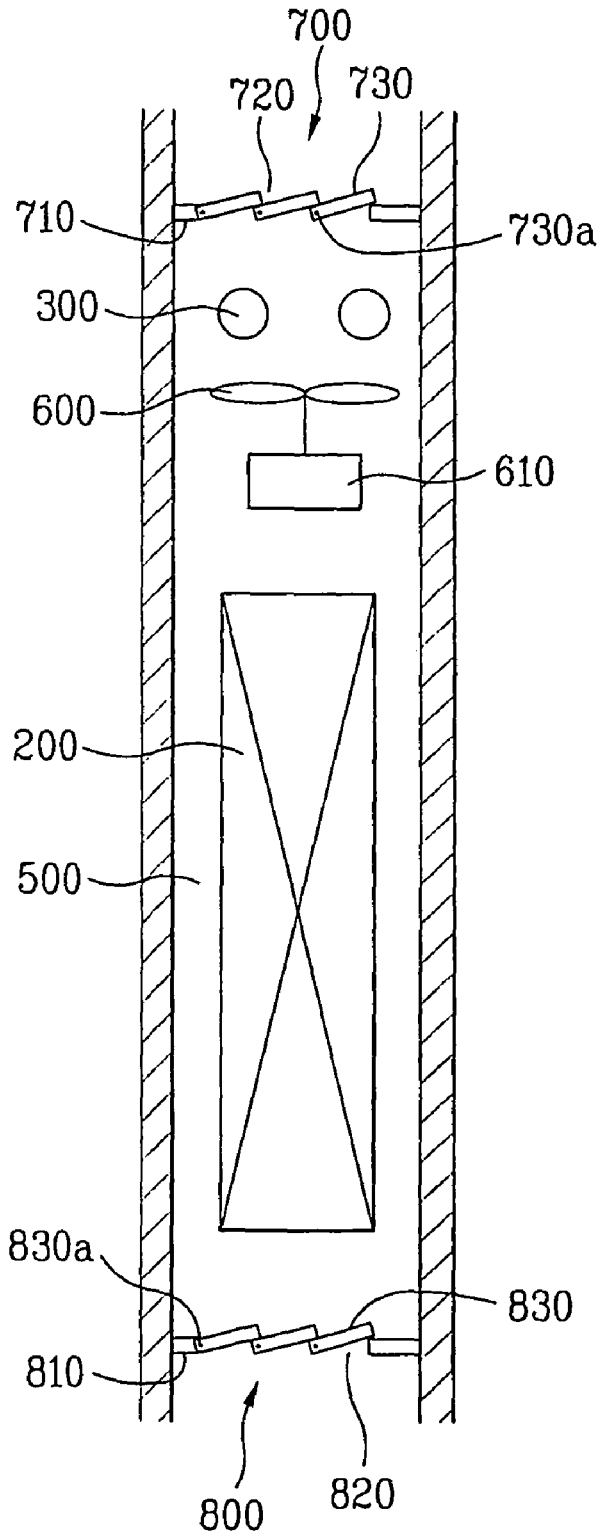

FIG. 3 illustrates a longitudinal section of refrigerator in accordance with a preferred embodiment of the present invention, and FIGS. 4 and 5 illustrate longitudinal sections each showing an enlarged view of a defroster in accordance with a preferred embodiment of the present invention.

Referring to FIG. 3, on a front side of an inside of a refrigerator case 100 in accordance with a preferred embodiment of the present invention, there are a freezing chamber 110, and a refrigerating chamber 111 partitioned in up/down direction with a barrier 101. Of course, the refrigerating chamber and the freezing chamber can be partitioned in left/right direction as required.

Behind the refrigerating chamber 111 and the freezing chamber 110, there is a cold air duct 500, and, in the duct 500, there are an evaporator 200 and a defroster. The duct 500 has a cold air outlet 510 and a cold air inlet 520 in an upper portion and a lower portion.

The defroster includes a fan 600, a motor 610, a defrosting heater 300, and open/close means 700, and 800.

The motor 610 can change a rotation direction of the fan 600, selectively. According to this, the cold air can be directed upward or downward selectively along the cold air duct with the fan 600 by the user or in response to a control signal from a controller.

In the meantime, for selective closure of a space having the evaporator 200 and the fan 600 provided therein, the open/close means is provided on an upper side and a lower side of the space. The open/close means includes a first open/close part 700, and a second open/close part 800.

The open/close parts will be described in more detail.

The first open/close part 700 is over a space having the evaporator 200 and the fan 600 provided therein, and includes a first supporting plate 710, and a first rotating plate 730. The first supporting plate 710 has a plurality of first openings 720 for pass of the cold air, and there are first rotating plates 730 rotatably mounted on circumferences of the first openings 720, respectively. It is preferable that the first rotating plate 730 is rotatably coupled to the supporting plate 730 with a hinge 730*a*.

The first rotating plate 730 is constructed from a thin plate, and is mounted to be rotatable selectively by force of a cold air flow generated when the fan 600 rotates. Therefore, the first rotating plates 730 are rotated to open/close the first openings 720 selectively depending of a flow direction of the cold air without separate driving means.

Referring to FIG. 4, when the cold air is directed upward, the first rotating plates 730 rotate upward about the hinges 730*a* respectively at predetermined angles, to open the first openings 720.

Opposite to this, referring to FIG. 5, when the cold air is directed downward, the first rotating plates 730 rotate to close the first openings 720, respectively. For this, the first rotating plate 730 has a size enough to cover an upper circumference of the first opening 720. Accordingly, as an edge of the first rotating plate 730 is held at the upper circumference of the first opening 720, or a rear end of an adjacent first rotating plate, downward rotation of the first rotating plate 730 is prevented.

On the other hand, the second open/close part 800 is provided on a lower side of the space the evaporator 200 and the fan 600 positioned therein, and includes a first supporting plate 810, and a second rotating plate 830. The second supporting plate 810 has a plurality of second openings 820 for pass of the cold air, and there are second rotating plates 830 provided to circumferences of the second openings 820, respectively. It is preferable that the second rotating plates 830 are coupled to the second supporting plate 810 with hinges 830*a*, respectively.

The second rotating plate 830 is constructed from a thin plate, and is mounted to be rotatable selectively by force of a cold air flow generated when the fan 600 rotates. Therefore, the second rotating plates 830 are rotated to open/close the second openings 820 selectively depending of a flow direction of the cold air without separate driving means.

Referring to FIG. 4, when the cold air is directed upward, the second rotating plates 830 rotate upward about the hinges 830*a* respectively at predetermined angles, to open the second openings 820.

Opposite to this, referring to FIG. 5, when the cold air is directed downward, the second rotating plates 830 rotate to close the second openings 820, respectively. For this, the second rotating plate 830 has a size enough to cover an upper circumference of the second opening 820. Accordingly, as an edge of the second rotating plate 830 is held at the upper circumference of the second opening 820, or a rear end of an adjacent second rotating plate, downward rotation of the second rotating plate 830 is prevented.

While the fan 600 is rotated in one direction to direct the cold air upward during cooling, the fan 600 is rotated in an opposite direction, such that the rotating plates 730, and 830 close the openings 720, and 820 during defrosting from the evaporator 200. That is, at the time of defrosting from the surface of the evaporator, the space between the first, and second openings 700, and 800 is closed.

During defrosting from the evaporator 200, since the space the evaporator 200 is positioned therein is closed, and the defrosting heater 300 is operated, transmission of heat from the heater 300 to the refrigerating chamber or the freezing chamber through the cold air duct is prevented. According to this, the heat is transmitted from the evaporator to the frost on the evaporator intensively, to melt and remove the frost.

In this instance, for effective use of the heat from the motor 610 and the defrosting heater, it is preferable that the fan 600 is mounted over the evaporator 200, and the defrosting heater 300 is mounted over the fan 600.

Mounted positions of the fan 600, the defrosting heater 300, and the evaporator 200 are not limited to above arrangement, but varied without departing from the spirit or scope of the inventions.

Figure 6:
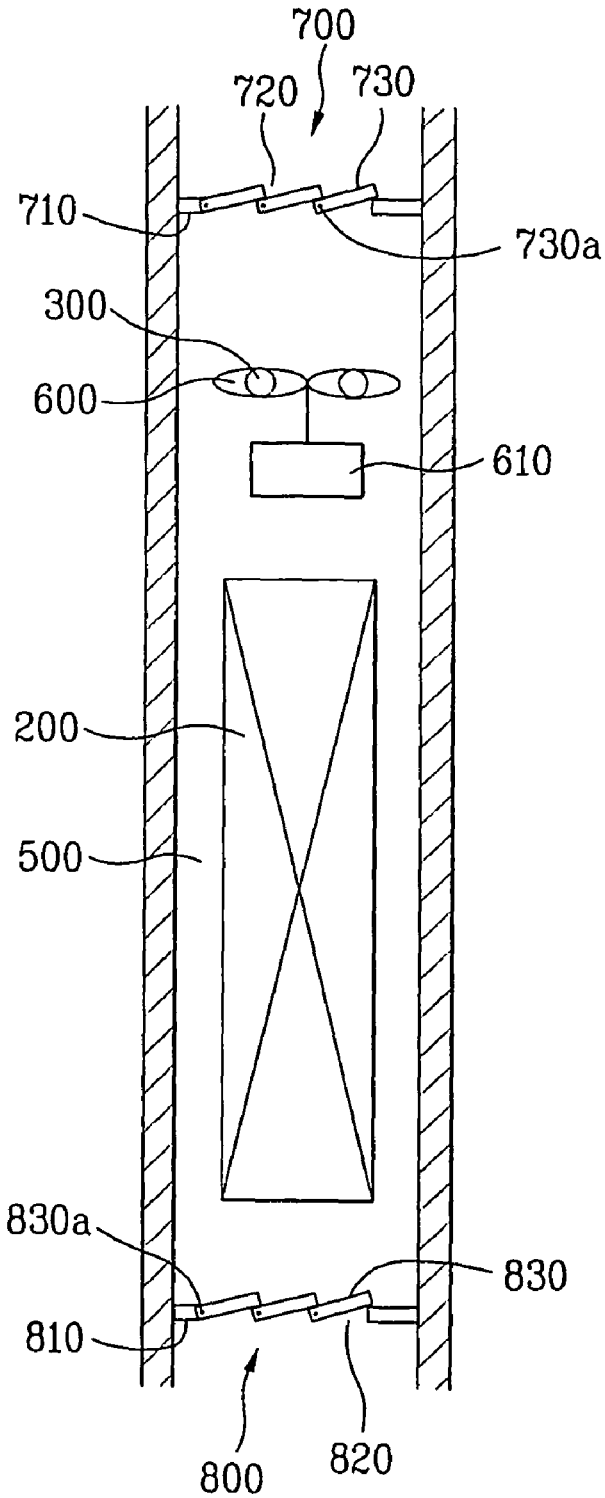

FIG. 6 illustrates a longitudinal section showing a fan having a defrosting heater in accordance with a preferred embodiment of the present invention fabricated as a unit with the fan.

Referring to FIG. 6, the defrosting heater 300 is fabricated as, a unit with the fan 600. In this instance, the defrosting heater 300 is fabricated as one unit with the fan on an outside circumferential surface of blades thereof, for generating heat. The fan 600 having the defrosting heater 300 fabricated as one unit therewith is mounted over or under the evaporator 200.

The defroster for an evaporator in a refrigerator in accordance with a preferred embodiment of the present invention will be described in detail.

For cooling air passed through the refrigerating chamber 111 or the freezing chamber 110, the fan 600 is rotated in one direction, and the air flows upward along the cold air duct 500. In this instance, the force of cold air flow rotates the first rotating plates 730 and the second rotating plates 830, to open the first openings 720, and the second openings 820.

According to this, the air is introduced through the second openings 820, heat exchanged at the evaporator 200 into cold air. Then, the cold air is discharged through the first openings 720, and introduced into the refrigerating chamber or the freezing chamber.

If above process is repeated, since, while a surface temperature of the evaporator 200 is low, a temperature of the air introduced thereto is high, the surface of the evaporator 200 is wet due to a temperature difference, to form frost as moisture freezes.

Defrosting is carried out for removing frost from the evaporator 200. For the defrosting, the fan 600 is rotated in an opposite direction. Upon rotation of the fan 600 in opposite direction, the air flows downward along the cold air duct 500. In this instance, the first rotating plates 730, and the second rotating plates 830 close the first openings 720, and the second openings 820 respectively, to close the space inside of the cold air duct 500 having the fan 600, the defrosting heater 300, and the evaporator 200 mounted therein.

Then, the defrosting heater 300 in the cold air duct 500 is operated. The heat from the defrosting heater 300 heats air inside of the cold air duct 500. The heated air is forcibly circulated downwardly by the fan 600, to melt, and remove frost from the surface of the evaporator 200.

Since the heated air is forcibly circulated within a closed cold air duct 500 during defrosting, the heated air is supplied to the evaporator, intensively. During the defrosting, heat from the motor 610 driving the fan 600 can also be transmitted to the frost. According to this, a time period required for the defrosting can be shortened, and the frost can be removed from the evaporator 200, effectively. After the frost is removed from the surface of the evaporator 200 by the defrosting, the cooling operation is carried out, again.

Figure 7:
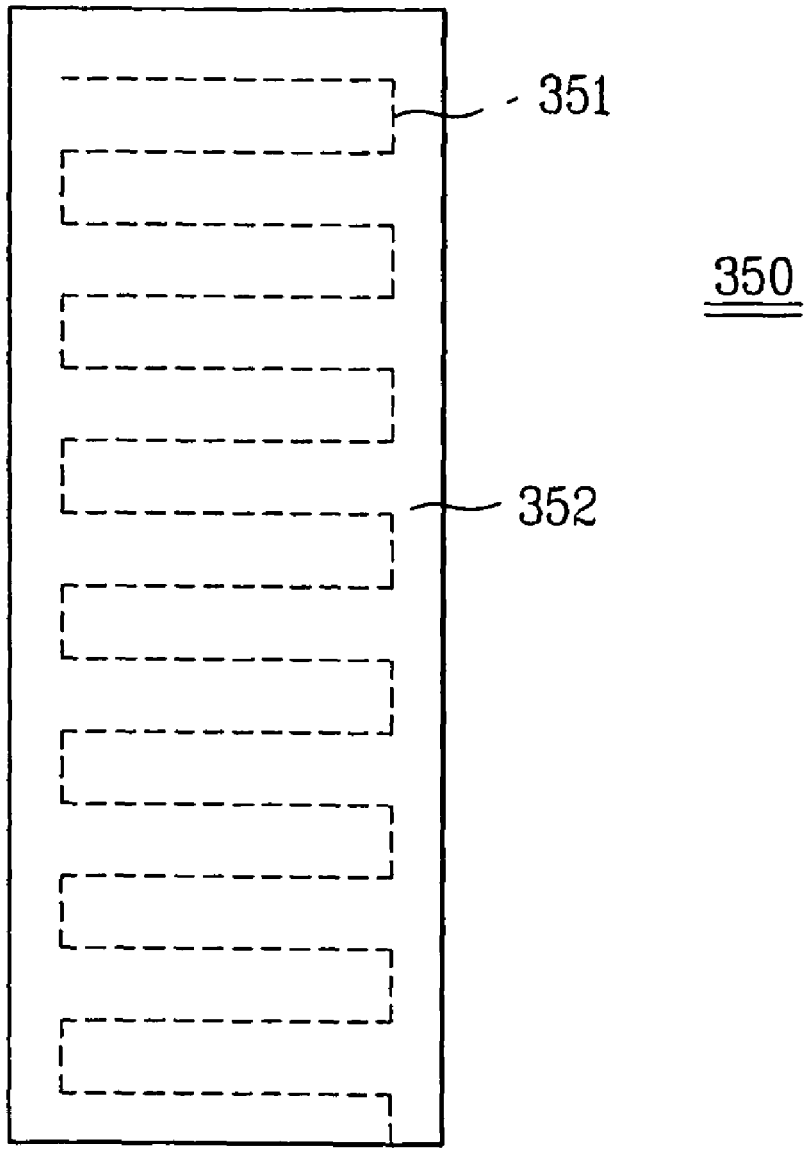
FIG. 7 illustrates a plan view of a defrosting heater in accordance with another preferred embodiment of the present invention.

In the meantime, a defroster for a refrigerator in accordance with another preferred embodiment of the present invention will be described. FIG. 7 illustrates a plan view of a defrosting heater in accordance with another preferred embodiment of the present invention.

Referring to FIG. 7, the defrosting heater 350 includes a hot wire 351 and a film 352 of an insulating material on an outside of the hot wire 351. It is preferable that the film 352 is formed of PET (Polyethylene terephthalate) having good electric insulating, and heat resisting properties. The hot wire 351 is surrounded, or coated with the film 352.

It is preferable that the hot wire 351 is a carbon hot wire. In order to increase a heat generating area per a unit space, the carbon hot wire is provided closely in a bent shape in the PET film, and electrically connected to the power source (not shown) of the refrigerator. Upon supplying power, the carbon hot wire generates heat owing to an internal resistance.

In the meantime, the defrosting heater 350 is mounted so as to be in direct contact with the evaporator 200. According to this, heat is conducted from the defrosting heater 350 to the frost through the evaporator 200.

Figure 8:
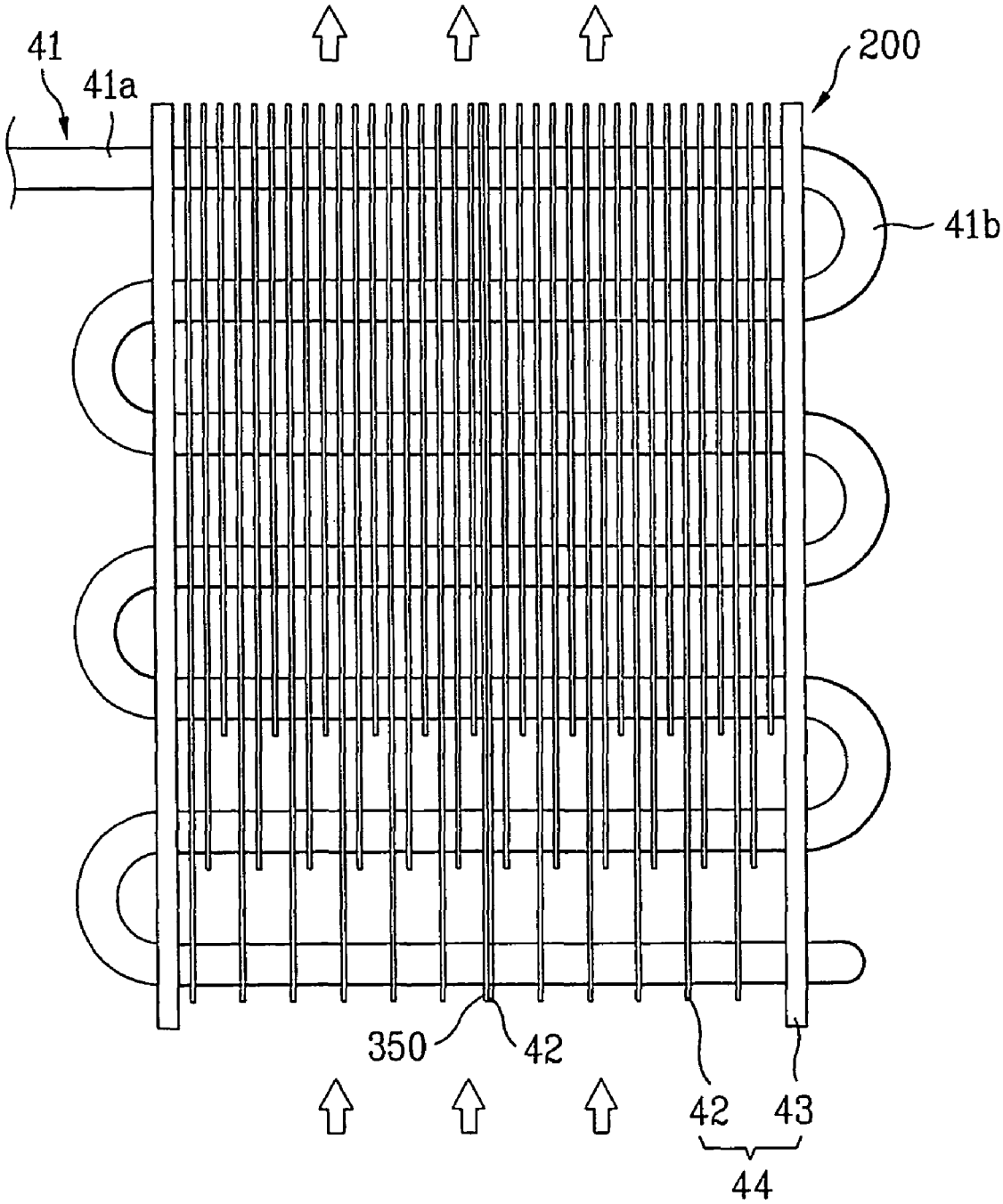
FIG. 8 illustrates a diagram of an evaporator and a defrosting heater attached thereto in accordance with a preferred embodiment of the invention.
Figure 9:
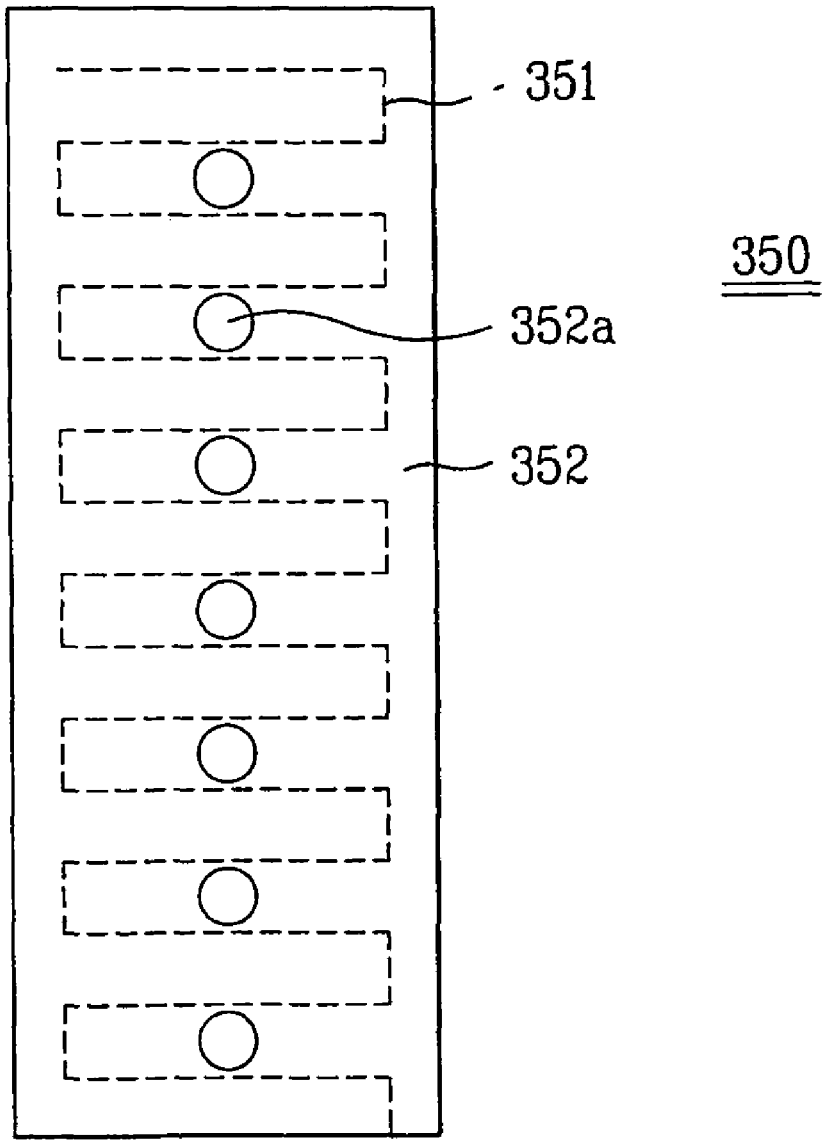
FIG. 9 illustrates a plan view of a defrosting heater in accordance with a preferred embodiment of the present invention.

FIGS. 8 and 9 illustrate diagrams each showing an evaporator and a defrosting heater attached thereto in accordance with a preferred embodiment of the invention.

Referring to FIG. 8, the evaporator 200 includes a refrigerating pipe 41 and fins 42.

The refrigerant pipe 41 having refrigerant flowing therein includes straight parts 41*a*, and bent parts 41*b*. The evaporator 200 is fabricated by inserting the fins 42 into the straight parts 41*a*, and welding the bent parts 41*b* to ends of the straight parts 41*a*. The ends of a plurality of straight parts 41*a* are connected with the bent parts, a fin part 44 is provided on outside circumferential surfaces of the straight parts 41*a*. The fin part 44 includes a plurality of fins 42 parallel to one another, and outer fins 43 on outer sides of the fins 42.

In the meantime, as the cooling operation is progressed, moisture in air is cooled down, and deposit on the fins 42 as frost. According to this, air flowing between the fins 42 is blocked by the frost, to impede heat transfer from the air to the fins 42.

In order to heat, and melt the frost, the defrosting heater 350 is attached to at least one of the fins 42.

Referring to FIG; 9, the film 352 of the insulating material has holes 352*a* for inserting the straight parts 41*a*. The carbon hot wire is between the holes 352*a* for generating heat by power.

Therefore, before welding the bent parts 41*b* to the ends of the straight parts 41*a*, the straight parts 41*a* are inserted through the holes 352*a* in the defrosting heater. Thereafter, the defrosting heater 350 is attached to one of sides of the fins 42.

Heat from the defrosting heater 350 is transmitted to the fins 42 by conduction, and the conducted heat melts, and removes frost from between the fins 42.

Figure 10:
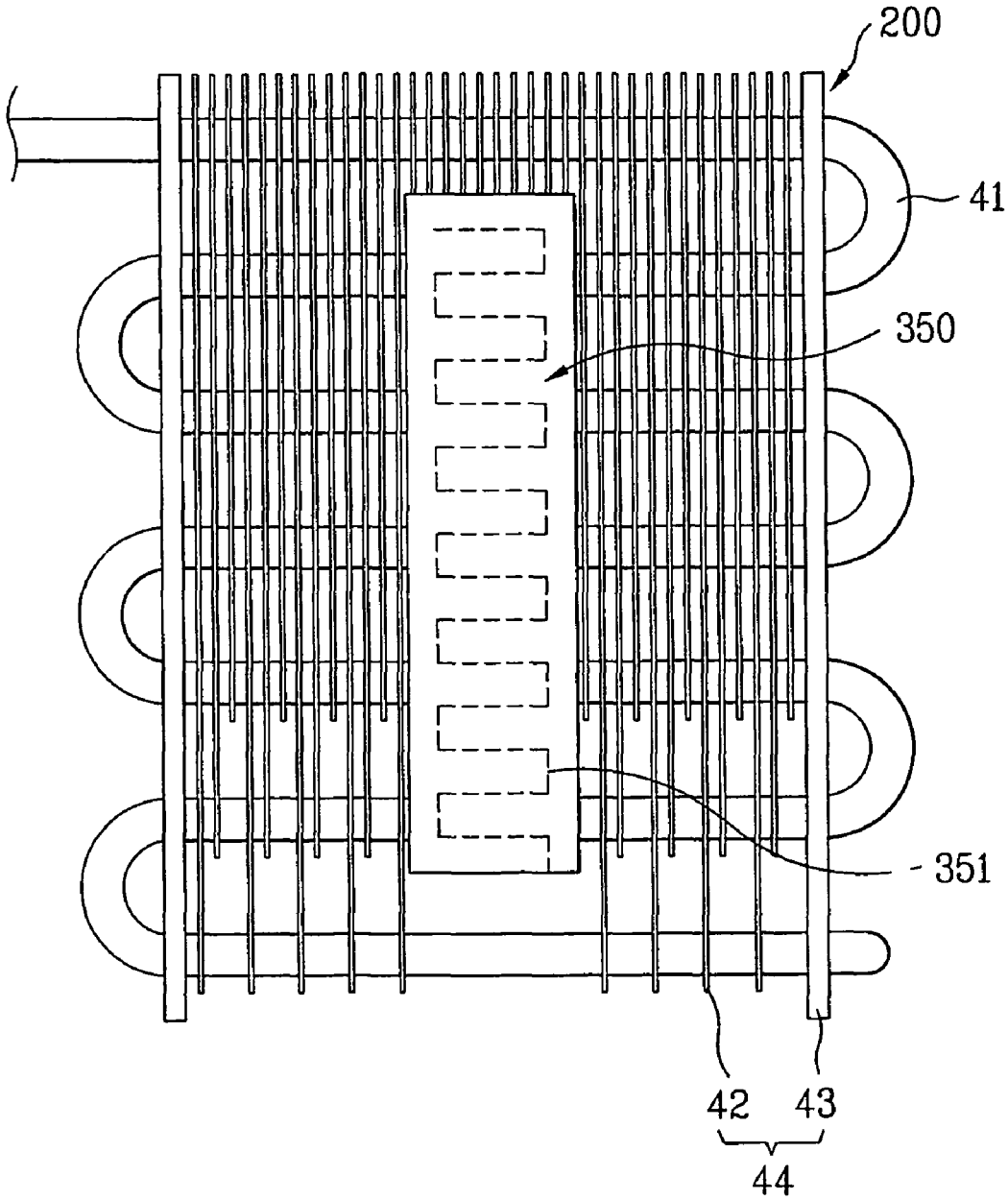
FIGS. 10~15 illustrate plan views each showing a structure in which a defrosting heater is mounted on an evaporator.
Figure 11:
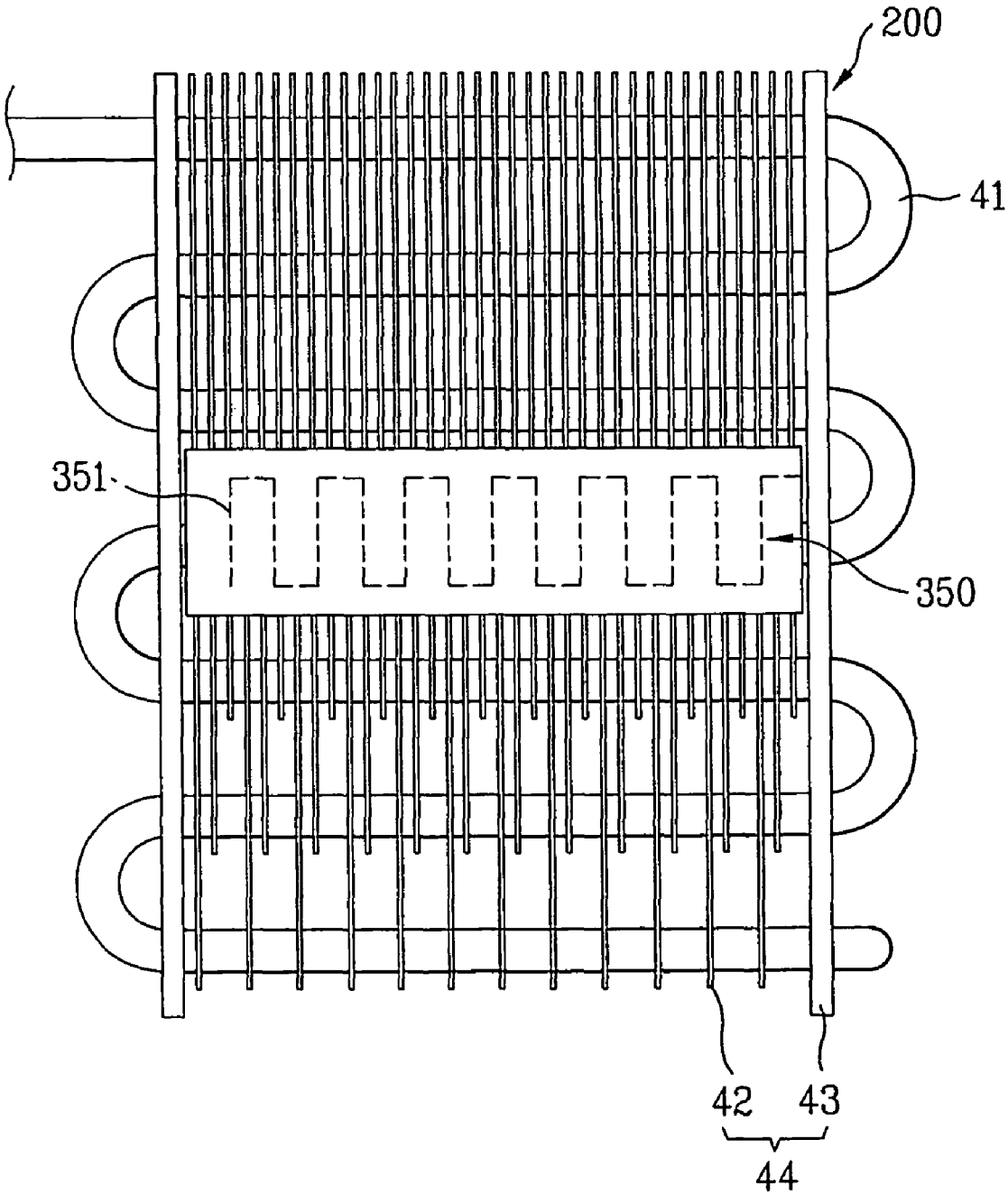

FIGS. 10 and 11 illustrate plan views each showing a defrosting heater attached to an outside surface of fins.

Referring to FIGS. 10 and 11, the defrosting heater 350 is in contact with outside circumferential surfaces of a plurality of fins 42. In this instance, the defrosting heater 350 may be mounted to the fins 42 parallel, or perpendicular to a length direction of the fins 42. Therefore, since the defrosting heater 350 is in contact with the plurality of fins 42, frost between the fins 42 can be heated, and removed, at the same time.

Figure 12:
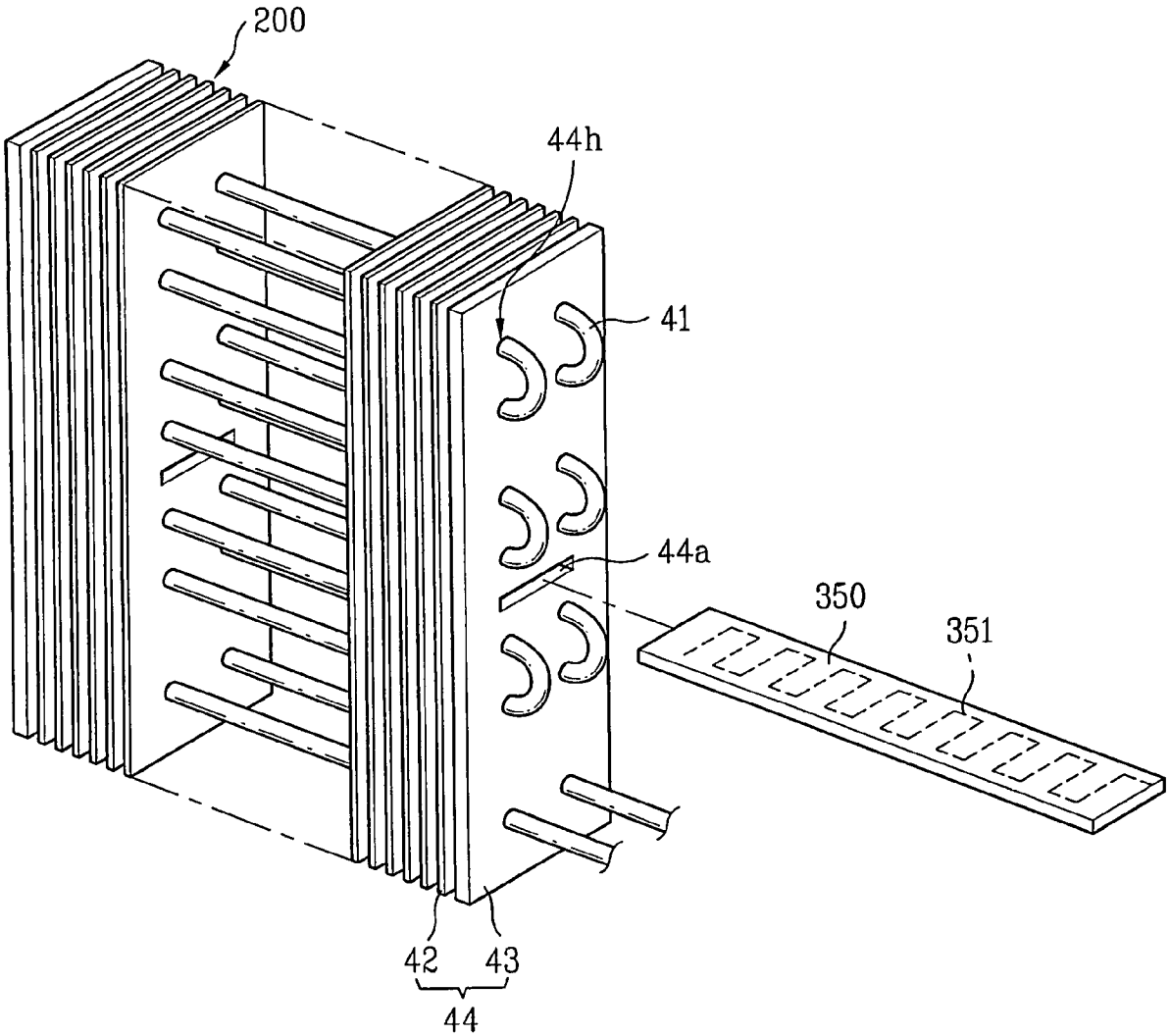
Figure 13:
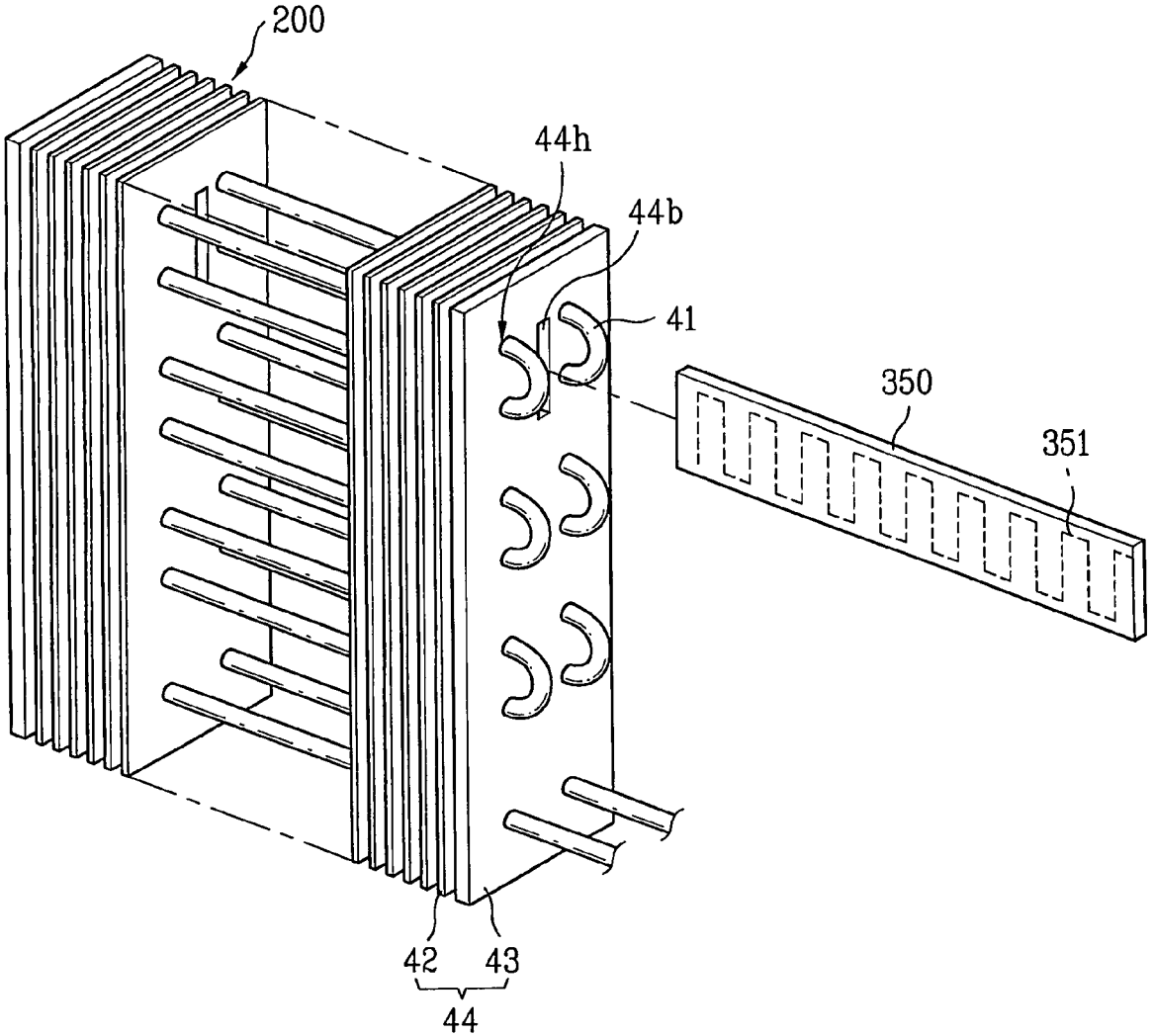

FIGS. 12 and 13 illustrates perspective views each showing pass through holes 44*a*, or 44*b* in the fins for pass of the defrosting heater 350. As shown, the pass through holes 44*a*, and 44*b* is formed along a long side, or short side of the fins 42.

The defrosting heater 350 is inserted in, and fixedly secured to the pass through hole 44*a*, or 44*b*. In this instance, since the defrosting heater 350 has a surface in contact with the fins 42, heat from the defrosting heater 350 is conducted through the fins 42 or convects on flowing air. Thus, as the heat is transmitted to the frost by conduction or convection, defrosting from the evaporator 200 is progressed.

Figure 14:
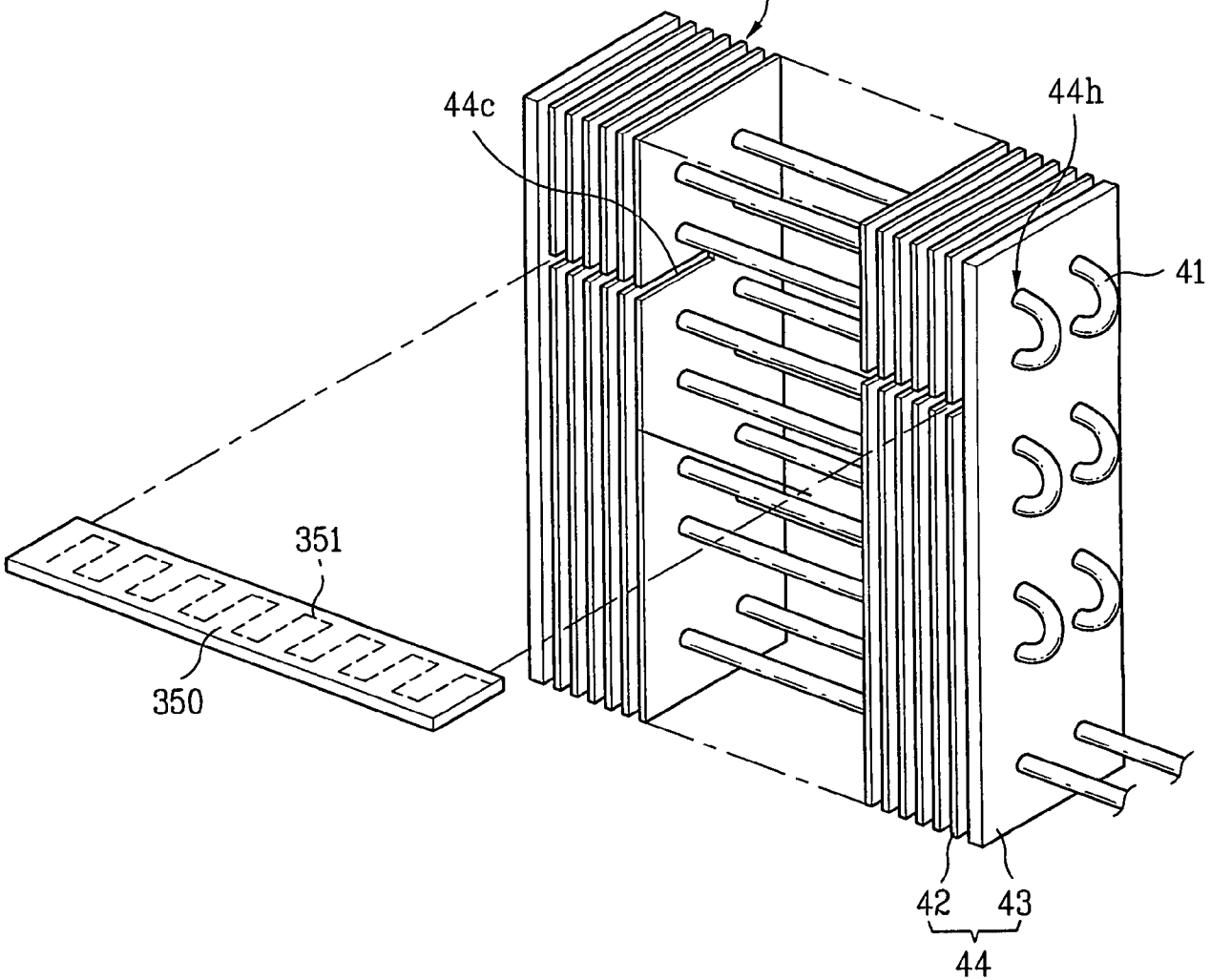
Figure 15:
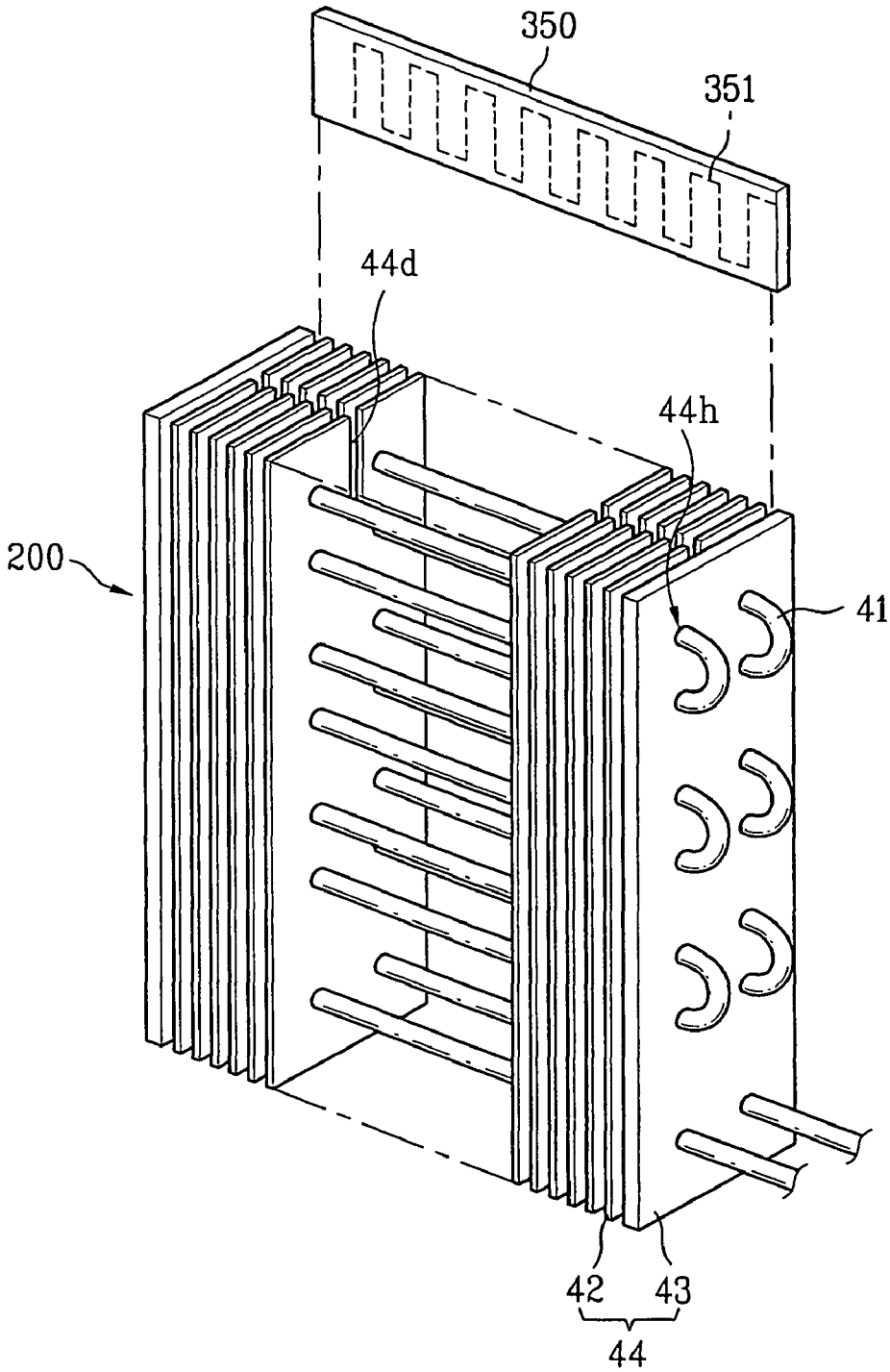

FIGS. 14 and 15 illustrate perspective views each showing an inserting slot in the fins for inserting the defrosting heater therein. As shown, the insertion slot 44*c* or 44*d* is formed in a long side, or short side of the fins 42. The defrosting heater 350 is inserted in, and secured to the insertion slot 44*c* or 44*d*. Therefore, the defrosting heater 350 can be mounted easier than the fins 42.

In this instance, the defrosting heater 350 has a surface in contact with the fins 42, and heat from the defrosting heater 350, not only convects, but also conducts through the fins 42. According to this, by the convecting, or conducting heat, the frost is melt and removed from the fins 42.

Because the heat is transmitted from the defrosting heater 350 to the frost, not only by convection, but also by conduction, the frost can be removed, more quickly.

Moreover, since the carbon hot wire in the defrosting heater 350 has a good power saving effect, a low electromagnetic wave emission, and a high rate of heat generation per a unit area. Therefore, since thickness and volume of the defrosting heater can be made small, a whole size of the refrigerator can be reduced. Moreover, a far infrared ray from the carbon hot wire prevents microbes from breeding, the carbon hot wire is advantageous in view of hygiene.

In the meantime, the defrosting heater 350 may be a PTC device (Positive Temperature Coefficient Device). The PTC device has a characteristic in which an electric resistance rises sharply at a temperature higher than the Curie temperature. Therefore, the PTC device has a self temperature controlling function in which a temperature of the PTC device rises to a certain temperature regardless of an environmental temperature if a voltage is applied to the PTC device.

As has been described, it is preferable that the defrosting heater 350 is mounted at a position where much frost forms in view of experiment.

Figure 16:
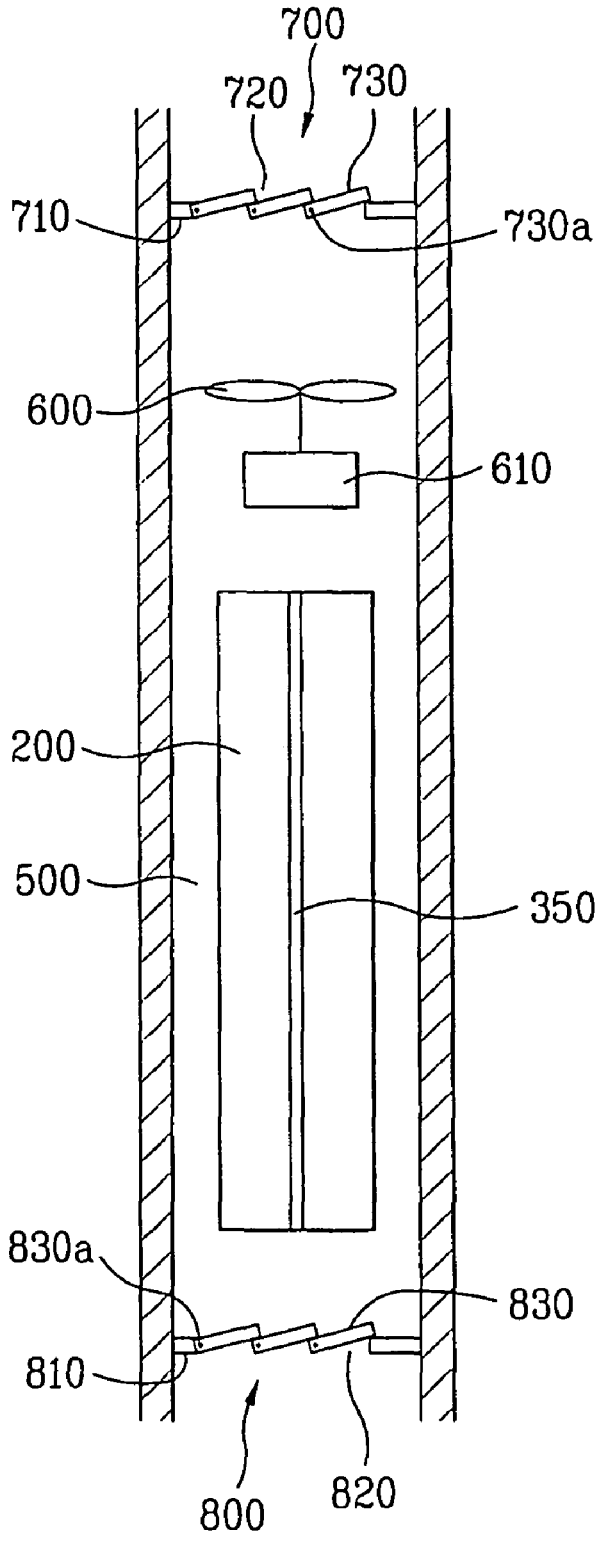
FIG. 16 illustrates a section showing a structure of a defrosting heater and an open/close means in accordance with a preferred embodiment of the present invention.

In the meantime, FIG. 16 illustrates a section showing a structure of a defrosting heater and an open/close means in accordance with another preferred embodiment of the present invention.

Referring to FIG. 16, provided in a cold air duct 500, there is an evaporator 200 having the defrosting heater 350 mounted thereon, and a fan 600 over, or under the evaporator 200. A space having the evaporator 200 and a fan 600 provided therein is closed by the open/close means. The open/close means includes a first open/close part 700 and a second open/close part 800 over and under the evaporator.

The open/close part 700, or 800 includes a supporting plate 710, or 810, and rotating plates 730, or 830, and there are openings 720 or 820 between the rotating plate 730, or 830, for pass of air.

As described before, if the air is directed upward by the fan 600, the rotating plate rotates, to open the openings. Opposite to this, if the air is directed downward, to close the rotating plates, to close the space having the evaporator 200 provided therein.

When the space having the evaporator 200 provided therein is closed, a process for defrosting from the evaporator 200 is carried out. The frost melts, and removed by heat from the defrosting heater 350 on the evaporator 200.

In this instance, since the space having the evaporator 200 provided therein is closed, transmission of the heat from the defrosting heater 350 to the refrigerating chamber and the freezing chamber through the cold duct 500 is prevented. Moreover, since the heat circulates only within the closed space, the defrosting progresses, effectively.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

INDUSTRIAL APPLICABILITY

As has been described, the refrigerator of the present invention has the following advantages.

First, the closure of the cold air duct space having the evaporator and the fan provided therein by the open/close means enables to circulate heated air within the closed space during defrosting, leading to melt, and remove frost from the surface of the evaporator effectively, to shorten a time period required for the defrosting and reduce power consumption of the refrigerator.

Second, not only heat from the defrosting heater, but also heat from the motor that drives the fan, can be used for defrosting, enabling to reduce a heat generating capacity of the defrosting heater, to improve safety of the refrigerator having refrigerant of an ammonia group that is explosive employed therein.

Third, the defrosting heater in direct contact with the evaporator permits to remove frost quickly as the heat is conducted from the defrosting heater to the evaporator directly.

Fourth, the attachment of the defrosting heater on a surface of the evaporator permits to reduce a volume, to reduce a size of the cold air duct as well as a size of whole refrigerator.

What is claimed is:

1. A refrigerator, comprising:

a cold air duct configured to receive cold air circulating inside of a refrigerating chamber and/or a freezing chamber;

an evaporator in the cold air duct;

at least one defrosting heater in the cold air duct configured to selectively emit heat;

a fan in the cold air duct that selectively directs the cold air in an upward or downward direction;

a motor that drives the fan; and an open/close device that selectively opens and closes a space containing the evaporator, the defrosting heater, and the fan positioned therein, wherein the space communicates with both the refrigerating chamber and the freezing chamber, wherein the open/close device is configured to be rotated by a force of a flow of the cold air generated by rotation of the fan so that the opening or closing between the space and the refrigerating chamber and the space and the freezing chamber are performed by the open/close device simultaneously, wherein the open/close device comprises a first open/close part on an upper side of the space and a second open/close part on a lower side of the space, and wherein the first and second open/close parts each comprises:

a supporting plate having a plurality of openings, the supporting plate being arranged above or below the fan and the evaporator, respectively; and a plurality of rotating plates, each having one side coupled to the supporting plate by hinges, and the other side being rotatable upward by a predetermined angle, wherein each of the plurality of rotating plates is independently coupled to the supporting plate without a connection to others of the plurality of rotating plates, wherein the plurality of rotating plates of the first open/close part is configured to rotate upwardly in a direction opposite to a location of the fan and the plurality of rotating plates of the second open/close part is configured to rotate upwardly in a direction toward the location of the fan when the air is directed upwardly by the fan during cooling so that the space communicates with the refrigerating chamber and the freezing chamber simultaneously, and wherein the plurality of rotating plates of the first open/close part is configured to rotate downwardly toward the location of the fan and the plurality of rotating plates of the second open/close part is configured to rotate downwardly in a direction opposite to the location of the fan when the air is directed downwardly by the fan during the defrosting so that the space is prevented from communicating with the refrigerating chamber and the freezing chamber simultaneously.

2. The refrigerator as claimed in claim 1, wherein each rotating plate comprises a thin plate that is rotated upward by a predetermined angle to open a respective opening of the plurality of openings.

3. The refrigerator as claimed in claim 1, wherein at least one of the rotating plates covers an upper circumference of the respective opening to close the opening.

4. The refrigerator as claimed in claim 1, wherein at least one of the rotating plates is held by a rear end of an adjacent rotating plate and the supporting plate, to prevent the rotating plate from rotating downward.

5. The refrigerator as claimed in claim 1, wherein the fan is positioned over the evaporator.

6. The refrigerator as claimed in claim 1, wherein the defrosting heater is positioned between the fan and the evaporator.

7. The refrigerator as claimed in claim 1, wherein the defrosting heater is fabricated as one unit with the fan.

8. The refrigerator as claimed in claim 1, wherein the defrosting heater comprises:

a hot wire that functions as a resistance body connected to a power source for emission of heat; and a film of an electrical insulating material surrounding the hot wire.

9. The refrigerator as claimed in claim 8, wherein the evaporator comprises:

at least one refrigerant pipe configured to receive a refrigerant that flows therethrough; and a plurality of fins in contact with the at least one refrigerant pipe.

10. A refrigerator, comprising:

a cold air duct configured to receive cold air circulating inside of a refrigerating chamber and a freezing chamber;

an evaporator disposed in the cold air duct, the evaporator comprising at least one refrigerant pipe configured to receive a refrigerant that flows therethrough, and a plurality of fins in contact with the at least one refrigerant pipe;

at least one defrosting heater in contact with one or more of the plurality of fins for selective emission of heat;

an open/close device provided at an upper portion and a lower portion of a space containing the evaporator and the defrosting heater positioned therein, that opens and closes the space;

a fan in the space that selectively directs the cold air in an upward or downward direction; and a motor that drives the fan, wherein the space communicates with both the refrigerating chamber and the freezing chamber, wherein the open/close device is configured to be rotated so that the opening or closing between the space and the refrigerating chamber and the space and the freezing chamber are performed by the open/close device simultaneously, and wherein the open/close device comprises a first open/close part on an upper side of the space and a second open/close part on a lower side of the space, and wherein the first and second open/close parts each comprises:

a supporting plate having a plurality of openings, the supporting plate being arranged above or below the fan and the evaporator, respectively; and a plurality of rotating plates, each having one side coupled to the supporting plate by hinges, and the other side being rotatable upward by a predetermined angle, wherein each of the plurality of rotating plates is independently coupled to the supporting plate without a connection to others of the plurality of rotating plates, wherein the plurality of rotating plates of the first open/close part is configured to rotate upwardly in a direction opposite to a location of the fan and the plurality of rotating plates of the second open/close part is configured to rotate upwardly in a direction toward the location of the fan when the air is directed upwardly by the fan during cooling so that the space communicates with the refrigerating chamber and the freezing chamber simultaneously, and wherein the plurality of rotating plates of the first open/close part is configured to rotate downwardly toward the location of the fan and the plurality of rotating plates of the second open/close part is configured to rotate downwardly in a direction opposite to the location of the fan when the air is directed downwardly by the fan during the defrosting so that the space is prevented from communicating with the refrigerating chamber and the freezing chamber simultaneously.

11. The refrigerator as claimed in claim 10, wherein the defrosting heater comprises:

a hot wire that functions as a resistance body connected to a power source for emission of heat; and a film of an electrical insulating material surrounding the hot wire.

12. The refrigerator as claimed in claim 11, wherein the hot wire is a bent carbon hot wire.

13. The refrigerator as claimed in claim 11, wherein the film is formed of PET material.

14. The refrigerator as claimed in claim 10, wherein the defrosting heater is a PTC device.

15. The refrigerator as claimed in claim 10, wherein the defrosting heater is attached to a surface of at least one of the plurality of fins.

16. The refrigerator as claimed in claim 10, wherein the defrosting heater is attached to one side of the plurality of fins.

17. The refrigerator as claimed in claim 10, wherein the defrosting heater has pass through holes for the at least one refrigerant pipe.

18. The refrigerator as claimed in claim 10, wherein at least a portion of the plurality of fins have insertion slots in side surfaces configured to receive the defrosting heater.

19. The refrigerator as claimed in claim 10, wherein at least one of the rotating plates comprises a thin plate that is rotated upward by a predetermined angle to open a respective opening of the plurality of openings.

20. The refrigerator as claimed in claim 10, wherein at least one of the rotating plates covers an upper circumference of the respective opening to close the opening.

* * * * *